US007187113B2

(12) United States Patent
Park et al.

(10) Patent No.: US 7,187,113 B2
(45) Date of Patent: Mar. 6, 2007

(54) COLOR CATHODE RAY TUBE CORRECTING BEAM LANDING ERRORS

(75) Inventors: Sang Yoon Park, Gumi-si (KR); Jong Eon Choi, Gumi-si (KR); Pyeong Soo Jeong, Daegukwayuk-si (KR)

(73) Assignee: LG.Philips Displays Korea Co., Ltd., Gumi-si (KR)

( * ) Notice: Subject to any disclaimer, the term of this patent is extended or adjusted under 35 U.S.C. 154(b) by 301 days.

(21) Appl. No.: 10/852,189

(22) Filed: May 25, 2004

(65) Prior Publication Data

US 2005/0057138 A1 Mar. 17, 2005

(30) Foreign Application Priority Data

Sep. 17, 2003 (KR) ..... 10-2003-0064598
Nov. 21, 2003 (KR) ..... 10-2003-0082847

(51) Int. Cl.
*H01J 29/80* (2006.01)

(52) U.S. Cl. ..... 313/407; 313/402; 313/404; 313/408

(58) Field of Classification Search ..... 313/407
See application file for complete search history.

(56) References Cited

U.S. PATENT DOCUMENTS 6,630,776 B2 * 10/2003 Nakayama et al. ..... 313/407
7,012,357 B2 * 3/2006 Kim ..... 313/402
2002/0038995 A1 * 4/2002 Fukao ..... 313/407

* cited by examiner

*Primary Examiner*—Sikha Roy
(74) *Attorney, Agent, or Firm*—Birch, Stewart, Kolasch & Birch, LLP

(57) ABSTRACT

A cathode ray tube includes a shadow mask having a faceplate portion and a skirt portion. The faceplate portion includes an apertured portion. A frame is provided having a supporting portion and a bottom portion that extends by width Da from the short side of the supporting portion. Da satisfies the relation Da<Ha×La/P+Na, where La represents a distance between a center point of the faceplate portion and a short side of the apertured portion, Na represents a distance between the short side of the apertured portion and a short side of the border of the faceplate portion, P represents a distance between the electron beams deflection center and the center point of the faceplate portion, and Ha represents a distance between the short side of the border of the faceplate portion and a short side of a rear end line of the supporting portion.

15 Claims, 10 Drawing Sheets

COLOR CATHODE RAY TUBE CORRECTING BEAM LANDING ERRORS

This Non-provisional application claims priority under 35 U.S.C. § 119(a) on Patent Application No(s). 10-2003-0064598 and 10-2003-0082847 filed in Korea on Sep. 17, 2003 and Nov. 21, 2003, respectively, the entire contents of which are hereby incorporated by reference.

TECHNICAL FIELD

The present invention relates to a color cathode ray tube and more specifically to a color cathode ray tube in which beam landing errors caused by non-uniform thermal expansion of a shadow mask are corrected such that color purity is improved.

BACKGROUND OF THE INVENTION

FIG. 1 shows a schematic diagram illustrating the structure of a general color cathode ray tube. As shown in FIG. 1, the color cathode ray tube generally includes a glass envelope having a shape of bulb and being comprised of a faceplate panel 10, a tubular neck, and a funnel 20 connecting the panel 10 and the neck.

The panel 10 comprises faceplate portion and peripheral sidewall portion sealed to the funnel 20. A phosphor screen 30 is formed on the inner surface of the faceplate portion. The phosphor screen 30 is coated by phosphor materials of R, G, and B. A multi-apertured color selection electrode, i.e., shadow mask 40 is mounted to the screen with a predetermined space. The shadow mask 40 is hold by a peripheral frame 70. An electron gun 50 is mounted within the neck to generate and direct electron beams 60 along paths through the mask to the screen.

The shadow mask 40 and the frame 70 constitute a mask-frame assembly. The mask-frame assembly is joined to the panel 10 by means of springs 80.

The cathode ray tube further comprises an inner shield 90 for shielding the tube from external geomagnetism, a reinforcing band attached to the sidewall portion of the panel 10 to prevent the cathode ray tube from being exploded by external shock, and external deflection yokes 110 located in the vicinity of the funnel-to-neck junction.

The electron beams generated by the electron guns are deflected in both vertical and horizontal directions by the deflection yokes 110. The electron beams are selected depending on the colors by the shadow mask and impinge on the phosphor screen such that the phosphor screen emits light in different colors. Typically, about 80% of the electrons from the electron guns 50 fail to pass through the apertures of the shadow mask 40. The 80% electrons impinge upon the shadow mask 40, producing heat and raising temperature of the mask 40.

FIG. 2 shows a perspective view of a quarter of a shadow mask illustrating thermal distribution of the surface of the mask due to the impingement of electrons. As shown in FIG. 2, temperature of the mask is different for different portion of the mask. In FIG. 2, center portion of the mask has higher temperature than corner portion. The reason why the corner portion has lower temperature is that the heat at the corner portion is dissipated through the frame attached to the mask. Since the frame is attached to the mask at the skirt portion near the corner, heat at the corner is easily transferred to outside via the frame. Because the mask is thermally expanded, position of the apertures at the shadow mask is accordingly shifted from the desired position. Therefore, electron beams passing through the apertures land at the screen incorrectly. In this way the color purity at the screen is degraded. This phenomenon of purity degradation resulting from the undesired positional shift of the apertures of the mask is called the "doming effect."

FIG. 3*a* shows cross sectional view of the shadow mask for illustrating purity degradation resulting from the positional shift of the apertures of the shadow mask 40. FIG. 3*b* is a graph showing variation of extent of positional shift of electrons landing incorrectly at the screen with respect to time after the cathode ray tube is operated.

As shown in FIG. 3*a*, electron beam landing at the screen is shifted due to the positional shift of the apertures of the shadow mask. As shown in FIG. 3*b*, the extent of the shift of the electron landing at the screen increases just after when the cathode ray tube is operated, since the temperature of the shadow mask increases. However, as heat at the shadow mask is transferred to the frame, the frame is heated and expanded. Accordingly, the positional shift of the electron landing is decreased. As the heat dissipation through the frame continues, the landing position of the electron beam is varied to the opposite direction with respect to the initial shift just after the operation of the shadow mask.

The variation of the shift of the electron beam landing causes degradation of color purity. Further, since landing position varies in accordance with the time after the shadow mask is operated, correction work of the aperture position with respect to the screen becomes difficult.

FIG. 4 is a schematic cross-sectional view of the conventional mask frame assembly. The conventional shadow mask 40 comprises a central apertured portion 401 through which electron beams pass, a non-apertured border portion 402 surrounding the apertured portion 401, and a peripheral skirt portion 403 bent back from the border portion and extending backward from the apertured portion 401.

According to the conventional mask frame assembly, the bottom portion 405 of the frame 404 intercepts electron beam 60 directed to the non-apertured border portion 402. Since electrons are blocked by the frame 404 before they impinge on the border portion, temperature elevation of the border portion is relatively small in comparison with that of the central portion of the mask. Therefore, non-uniformity of thermal expansion across the shadow mask is increased. Accordingly, the conventional shadow mask suffers from color purity degradation caused by the doming effect.

Also, improvement of the material used for the shadow mask was suggested. Invar material having low thermal expansion rate was used for the shadow mask instead of AK material. However, the result of using the invar material was not so satisfactory in view of the price of the material.

SUMMARY OF THE INVENTION

An object of the present invention is to provide a color cathode ray tube where landing error problem causing degradation of color purity is prevented.

Another object of the present invention is to provide a color cathode ray tube where non-uniform thermal expansion of the shadow mask is avoided such that color purity is improved.

Further object of the present invention is to provide a color cathode ray tube where the influence of electron beam impingement on thermal expansion of the shadow mask is minimized such that color purity is improved.

According to an aspect of the present invention a cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from said faceplate portion, said faceplate portion further comprising an apertured portion and a non-apertured portion surrounding said apertured portion; and a frame having a supporting portion joined to said skirt portion and a bottom portion bent inward from said supporting portion and extending by width Da from the short side of said supporting portion, wherein Da satisfies: $Da<Ha\times La/P+Na$ where La represents distance between center point Fx of said faceplate portion and a short side of said apertured portion; Na represents distance between the short side of said apertured portion and a short side of border of said faceplate portion from which said skirt portion is bent; P represents distance between the electron beams deflection center Dx and the center point Fx of said faceplate portion; Ha represents distance between the short side of the border of said faceplate portion and a short side of rear end line of said supporting portion from which the bottom portion is bent.

According to another aspect of the present invention, a cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from said faceplate portion, said faceplate portion further comprising an apertured portion and a non-apertured portion surrounding said apertured portion; and a frame having a supporting portion joined to said skirt portion and a bottom portion bent inward from said supporting portion and extending by width Db from the long side of said supporting portion, wherein Db satisfies: $Db<Hb\times Lb/P+Nb$ where Lb represents distance between center point Fx of said faceplate portion and a long side of said apertured portion; Nb represents distance between the long side of said apertured portion and a long side of border of said faceplate portion from which said skirt portion is bent; P represents distance between the electron beams deflection center Dx and the center point Fx of said faceplate portion; Hb represents distance between the long side of the border of said faceplate portion and a long side of rear end line of said supporting portion from which said bottom portion is bent.

DETAILED DESCRIPTION

Preferred embodiments of the present invention will be described in a more detailed manner with reference to the drawings.

<Embodiment 1>

According to an aspect of the present invention, A cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from said faceplate portion, said faceplate portion further comprising an apertured portion and a non-apertured portion surrounding said apertured portion; and a frame having a supporting portion joined to said skirt portion and a bottom portion bent inward from said supporting portion and extending by width Da from the short side of said supporting portion, wherein Da satisfies: $Da<Ha\times La/P+Na$ where La represents distance between center point Fx of said faceplate portion and a short side of said apertured portion; Na represents distance between the short side of said apertured portion and a short side of border of said faceplate portion from which said skirt portion is bent; P represents distance between the electron beams deflection center Dx and the center point Fx of said faceplate portion; Ha represents distance between the short side of the border of said faceplate portion and a short side of rear end line of said supporting portion from which the bottom portion is bent.

Figure 1:
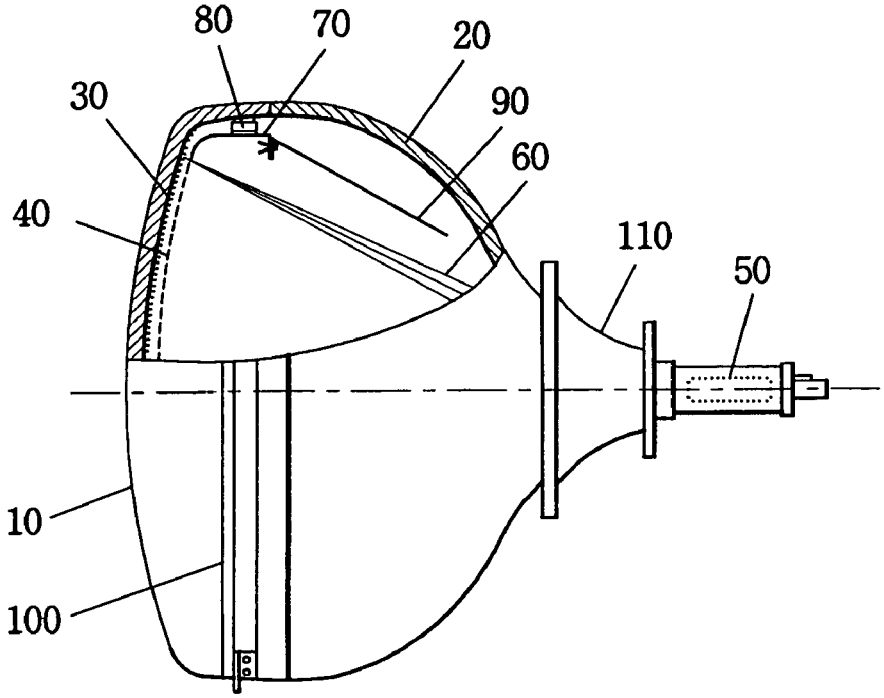
Fig. 1 Prior Art
FIG. 1 shows a schematic diagram illustrating the structure of a general color cathode ray tube.
Figure 2:
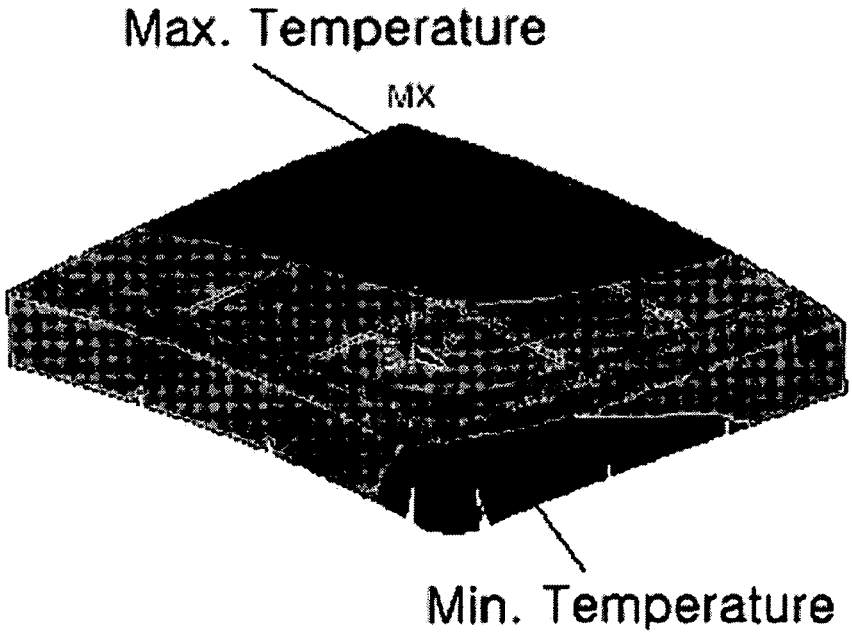
Fig. 2 Prior Art
FIG. 2 shows a perspective view of a quarter of a shadow mask illustrating thermal distribution of the surface of the mask due to the impingement of electrons.
Figure 3A:
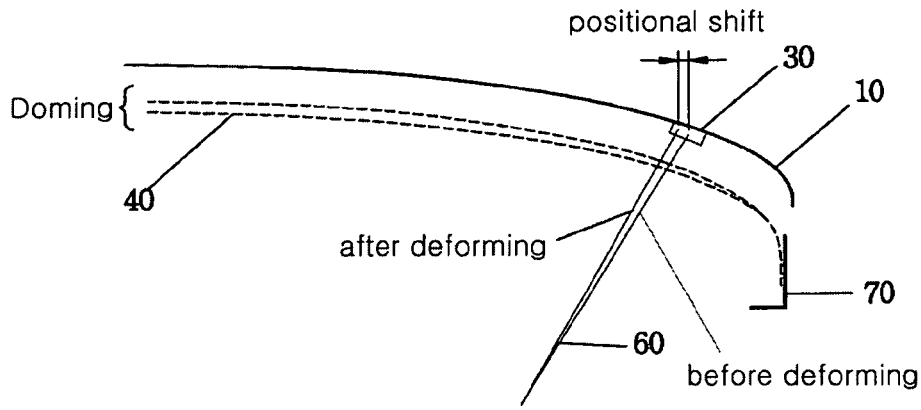
Fig. 3a Prior Art
FIG. 3*a* shows cross sectional view of the shadow mask for illustrating purity degradation resulting from the positional shift of the apertures of the shadow mask.
Figure 3B:
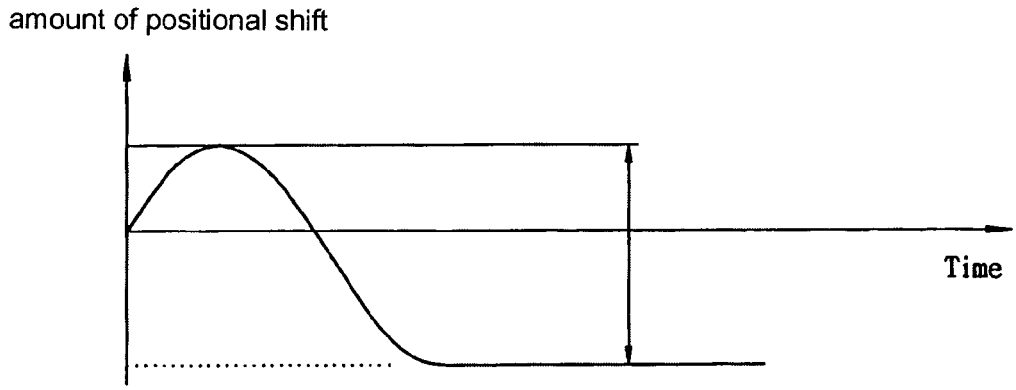
Fig. 3b Prior Art
FIG. 3*b* shows a graph showing variation of amount of positional shift of electrons landing incorrectly at the screen with respect to time after the cathode ray tube is operated.
Figure 4:
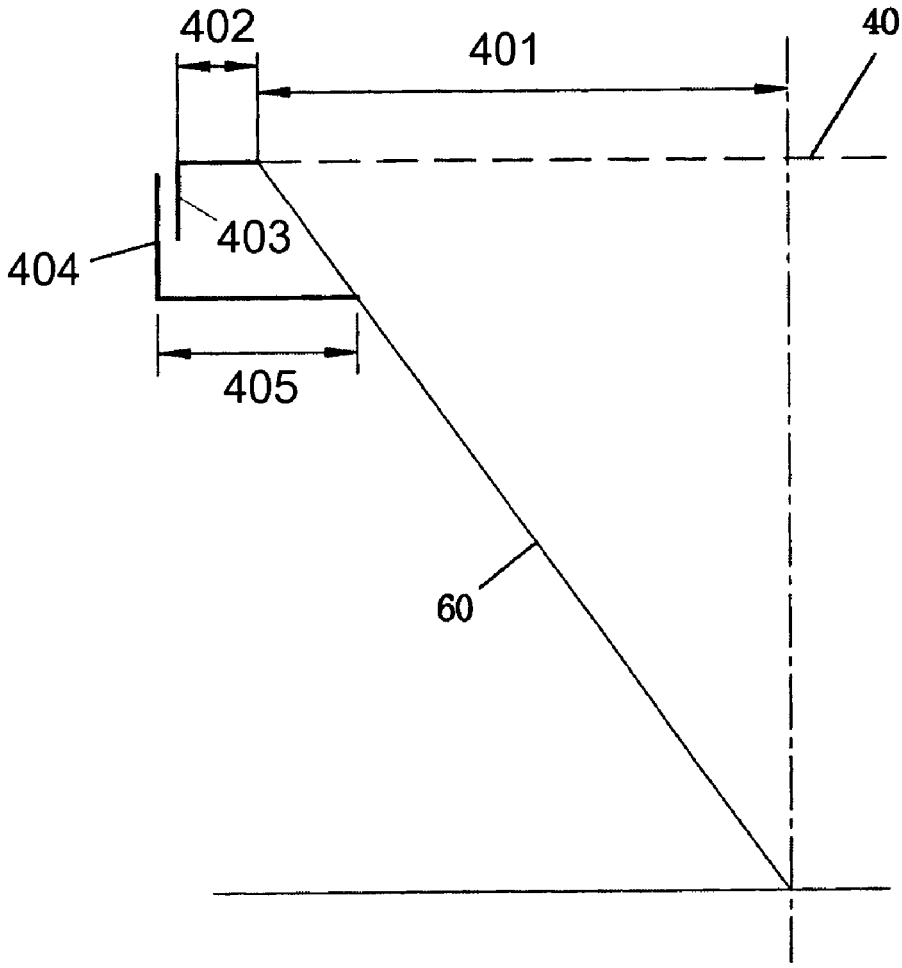
Fig. 4 Prior Art
FIG. 4 shows a schematic cross-sectional view of the conventional mask frame assembly.
Figure 5A:
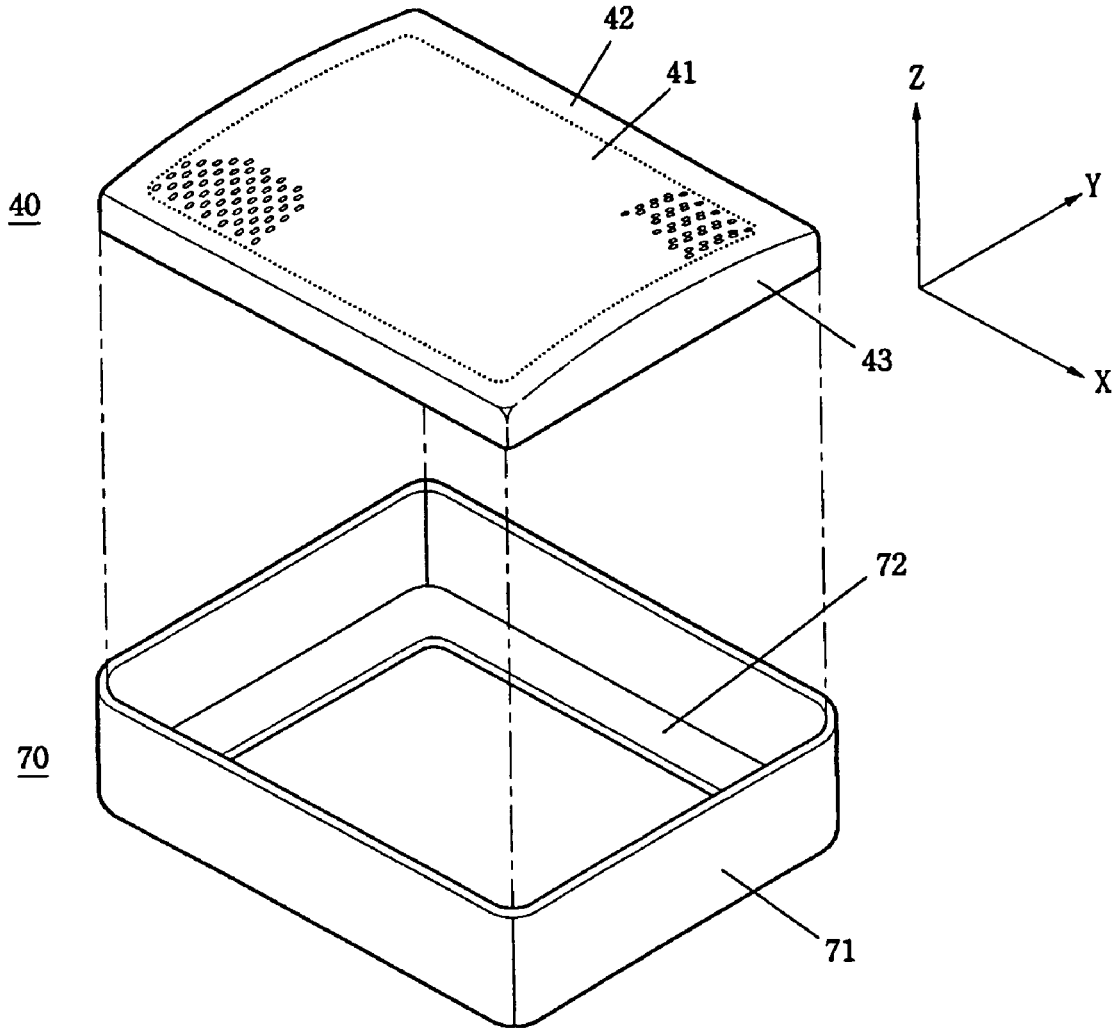
FIG. 5*a* shows a perspective view of the mask-frame assembly in accordance with Embodiment 1 of the present invention.

FIG. 5*a* shows a perspective view of the mask-frame assembly in accordance with Embodiment 1 of the present invention.

As shown in FIG. 5*a*, the shadow mask 40 in accordance with Embodiment 1 of the present invention comprises a faceplate portion and a peripheral skirt portion 43 bent back from the faceplate portion and extending backward from faceplate portion. The faceplate portion further comprises an apertured portion 41 where minute apertures through which electron beams pass are defined and a non-apertured border portion 42 surrounding the apertured portion 41.

The frame 70 comprises a supporting portion 71 which is joined to the skirt portion 43, and a bottom portion 72 which is bent inward from the supporting portion 71 and extending in parallel with the non-apertured border portion 42 of the shadow mask 40.

Hereinafter, sides of the mask-frame assembly which are in parallel with long axis, i.e., X axis in FIG. 5*a*, are called long sides. Sides of the mask-frame assembly which are in parallel with short axis, i.e., Y axis in FIG. 5*a*, are called short sides.

Embodiment 1 is related to optimization of long sides of the mask-frame assembly to reduce landing errors in a direction of long axis.

Figure 5B:
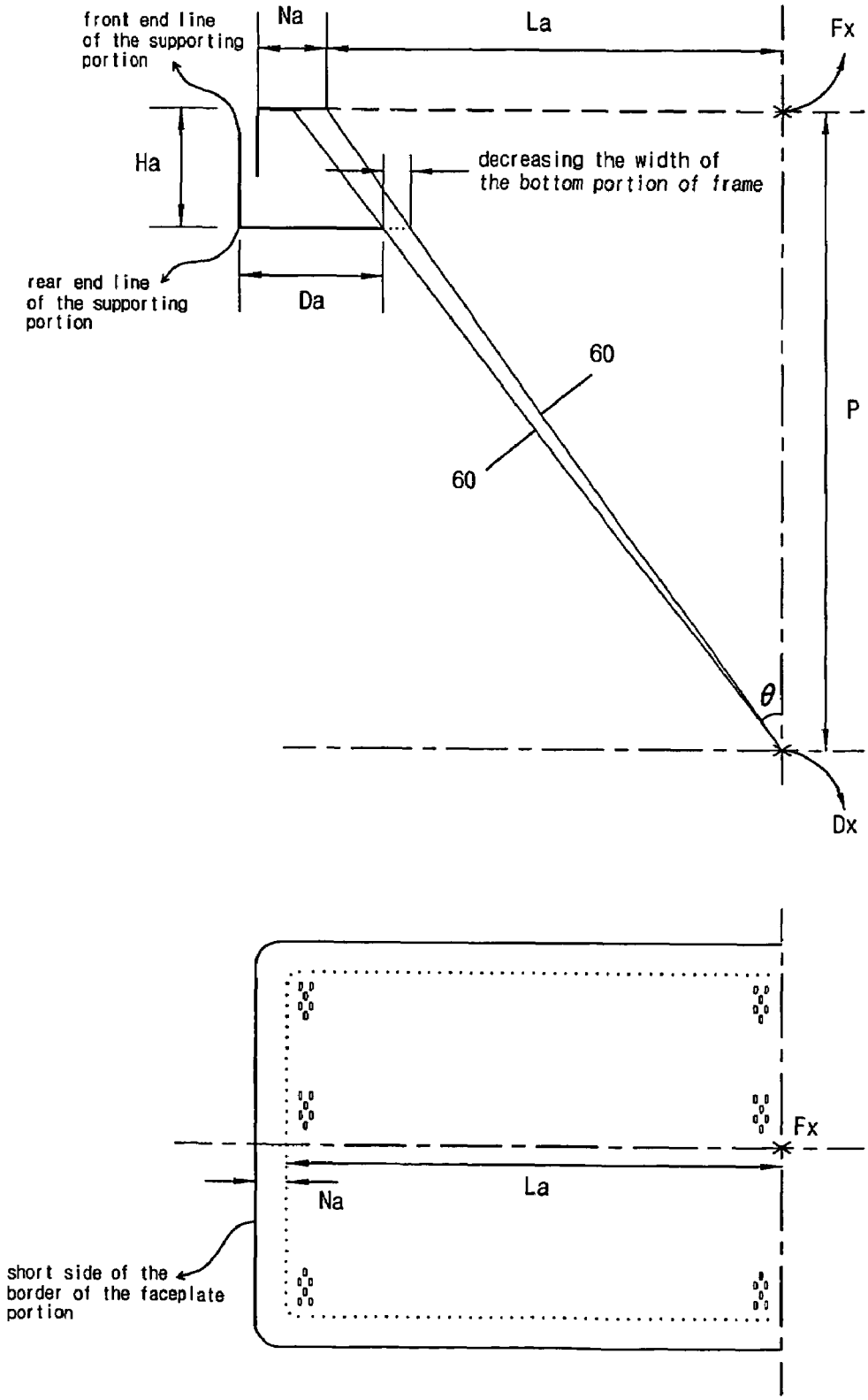
FIG. 5*b* shows a cross sectional view of the mask-frame assembly showing a minor side of the mask-frame assembly.

FIG. 5*b* is a cross sectional view of the mask-frame assembly showing a long side of the mask-frame assembly. Hereinafter, following parameters are used in the description of the present invention. It is assumed that the faceplate portion of the mask is substantially flat.

La represents distance between center point Fx of faceplate portion and a short side of apertured portion.

Na represents distance between a short side of the apertured portion and a short side of border of faceplate portion from which skirt portion is bent.

P represents distance between electron beams deflection center Dx and the center point Fx of faceplate portion.

Ha represents distance between the short side of border of faceplate portion and a short side of rear end line of the supporting portion of the frame from which the bottom portion is bent.

Da represents width of the bottom portion by which the bottom portion extends inward from the rear end line of the short side of the supporting portion of the frame.

Figure 6:
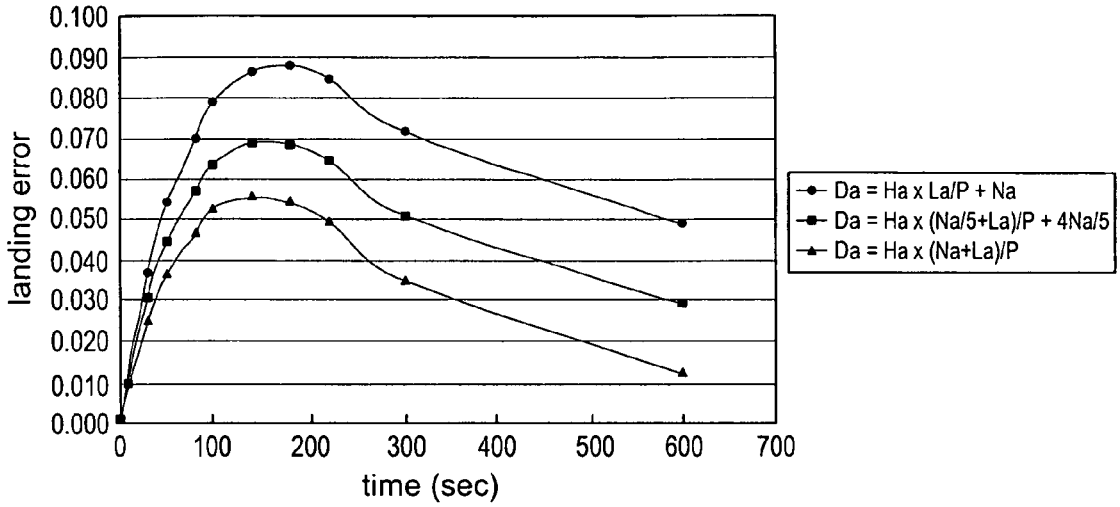
FIG. 6 shows a graph for illustrating the result of Table 1.

Table 1 is the result of an experiment where landing error was measured for various frames having bottom portions of various widths. FIG. 6 shows a graph for illustrating the result of Table 1.

TABLE 1

| time(sec) | | conventional Da = Ha × La/P + Na | experiment 1 of the present invention Da = Ha × (Na/5 + La)/P + 4Na/5 | experiment 2 of the present invention Da = Ha × (Na + La)/P |
|---|---|---|---|---|
| 1 | landing | 0.002 | 0.002 | 0.001 |
| 30 | error | 0.037 | 0.031 | 0.026 |
| 50 | | 0.054 | 0.045 | 0.037 |
| 80 | | 0.070 | 0.058 | 0.047 |
| 100 | | 0.079 | 0.064 | 0.053 |
| 140 | | 0.087 | 0.069 | 0.056 |
| 180 | | 0.088 | 0.069 | 0.055 |
| 220 | | 0.085 | 0.065 | 0.050 |
| 300 | | 0.072 | 0.051 | 0.035 |
| 600 | | 0.049 | 0.029 | 0.012 |

As shown in Table 1 and FIG. 6, landing error become severe when electron beam impinges only on the apertured portion and is blocked by the bottom portion of the frame such that it does not reach the non-apertured portion. This is because the temperature elevation becomes non-uniform between the apertured and non-apertured portions of the shadow mask resulting in non-uniform thermal expansion of the shadow mask.

The inventor carried out experiments on the width of the bottom portion to find out adequate width of the bottom portion which makes the electron beam reach to the non-apertured portion of the shadow mask. The width of the bottom portion was designed variously. According to the present invention, the width of the bottom portion is decreased in comparison with the prior art such that the area on the shadow mask on which electron beam impinges is increased. It was found from the experiment that when the width of the bottom portion Da satisfies following Eqn. 1, the area on the shadow mask on which electron beam impinges is increased and, accordingly, temperature difference between central and border portion of the shadow mask is decreased. Therefore, amount of landing error is also decreased.

$$Da<Ha\times La/P+Na \qquad \text{Eqn. 1}$$

When the width Da of the bottom portion is substantially equal to Ha×La/P+Na, electron beams impinge on as far as the border of the non-apertured portion of the shadow mask. In this case, it was found that landing error is reduced by 36%, as shown in Table 1 and FIG. 6. In this manner, amount of electrons which reach the non-apertured portion increase as Da decreases. As the amount of electrons reaching the non-apertured portion increase, landing error is reduced and thereby doming problem is solved.

Moreover, when the width Da of the bottom portion satisifies following Eqn. 2, electron beams are made to impinge on no smaller than ⅘ of the non-apertured portion of the shadow mask. As can be seen from Table 1 and FIG. 6, if the width Da of the bottom portion is substantially equal to Ha×(Na/5+La)/P+4Na/5, electron beams reach ⅘ of the non-apertured portion and, landing error is reduced by 21%.

$$Da<Ha\times(Na/5+La)/P+4Na/5 \qquad \text{Eqn. 2}$$

For the Embodiment 1 described hereinabove, even when AK material, which has larger thermal expansion rate than Invar material, is used for the shadow mask, landing error is the same or even remarkably reduced in comparison with the prior art.

Further, any electron beam reflecting material may be coated on the surface of the shadow mask upon which electron beams are incident. With the reflecting material, heat generation due to impinge of electron beams is reduced. Therefore, temperature elevation of the shadow mask is reduced and, accordingly, landing error is further reduced.

Further, in addition to the use of AK material for the shadow mask, the electron beam reflecting material may also be coated on the surface of the shadow mask upon which electron beams are incident. In this manner, temperature elevation of the shadow mask is further reduced and, accordingly, landing error is further reduced.

Figure 7A:
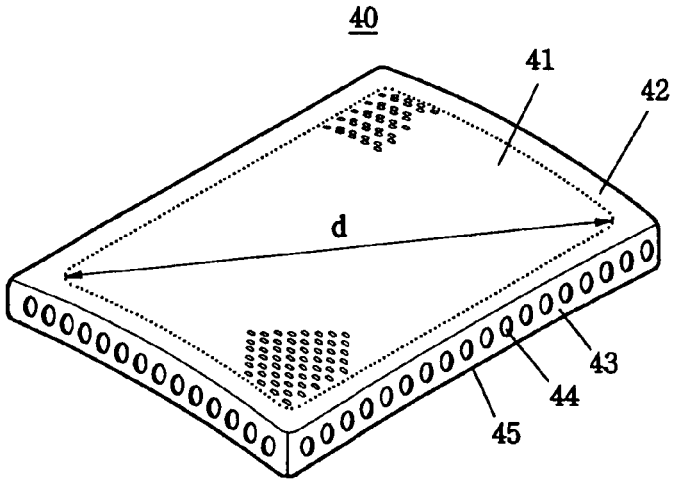
FIGS. 7*a* and 7*b* show a modified version of Embodiment 1 of the present invention.
Figure 7B:
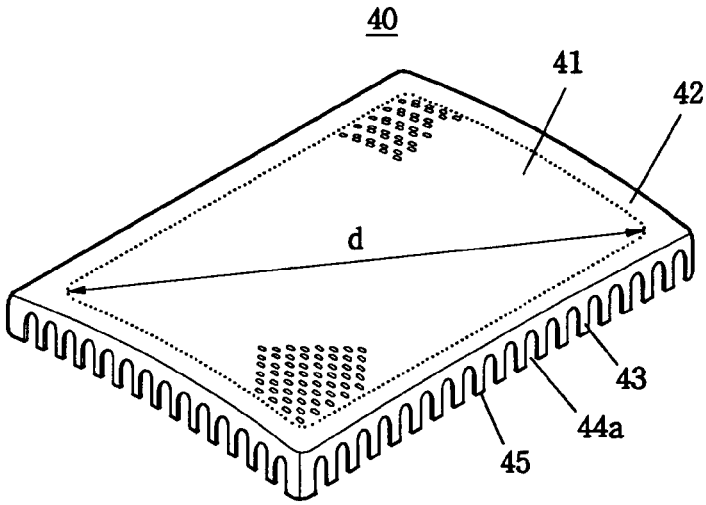

FIGS. 7*a* and 7*b* show a modified version of Embodiment 1 of the present invention.

According to the modified version of Embodiment 1 of the present invention, in addition to reducing the width Da of the bottom portion or limiting the width to an appropriate scope, holes 44 are perforated at the skirt portion 43. With the holes 44, heat transfer from the shadow mask 40 to the frame can be reduced further. Accordingly, landing error of the electron beams could also be remarkably reduced. According to another modified version of Embodiment 1, the holes 44 may have various shapes, e.g., circular, elliptical, or rectangular shape. According to further modified version of Embodiment 1, the holes may be opened to the backward direction from the front face side of the shadow mask 40. Further, the opened holes 44*a* may be perforated at the part of the skirt portion 43 which is opposite to the frame.

According to another modified version of Embodiment 1 of the present invention, by making the portion of the skirt portion 43, which is opposite to the frame, to be as small as possible, heat transfer between the skirt portion 43 and the frame is minimized. Accordingly, non-uniformity of thermal expansion between the central and peripheral portions in the shadow mask is decreased such that landing error of electron beam caused by the non-uniformity of expansion is decreased.

Figure 8A:
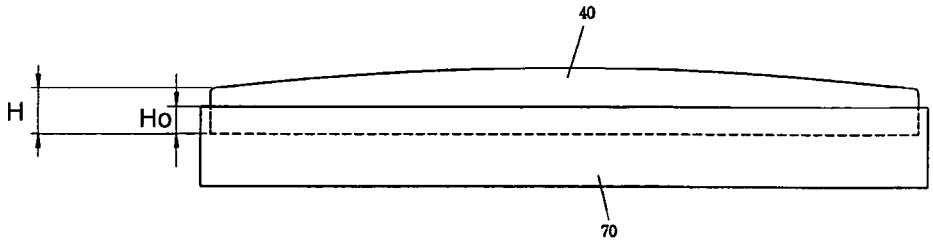
FIGS. 8*a* and 8*b* show side view of the mask-frame assembly to illustrate an example of the skirt portions having relatively long and short lengths respectively.
Figure 8B:
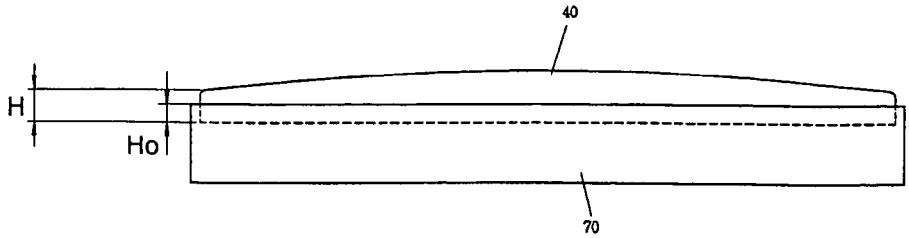

The inventor carried out experiments on the height of the skirt portion to find out adequate size of the skirt portion which makes the area of the part of the skirt portion opposite to the frame to be as small as possible. The height of the overall skirt portion was designed variously. FIGS. 8*a* and 8*b* show side view of the mask-frame assembly to illustrate an example of the skirt portions having relatively long and short lengths respectively. As shown in FIGS. 8*a* and 8*b*, as the height H of the skirt portion decreases, the Height Ho of the part of the skirt portion which is opposite to the frame decreases accordingly.

Figure 9:
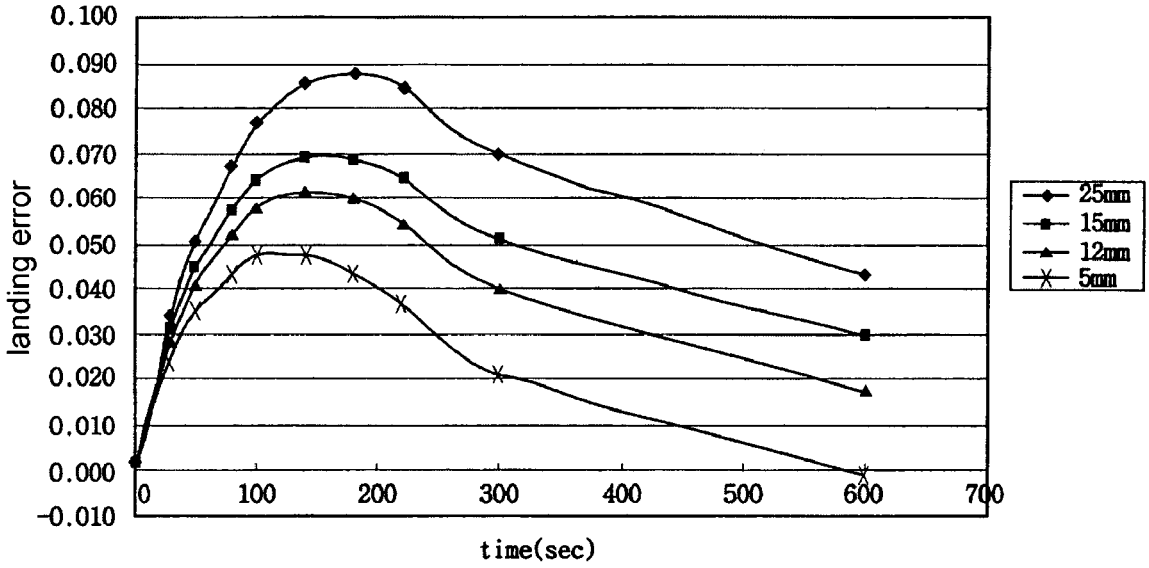
FIG. 9 shows a graph for illustrating the result of Table 2.

Table 2 is the result of an experiment where landing error was measured for various shadow masks having skirt portions of various heights H. FIG. 9 shows a graph for illustrating the result of Table 2.

TABLE 2

| Item | | Height H of the skirt portion (mm) | | | | |
|---|---|---|---|---|---|---|
| | | Prior Art | | The Present invention | | |
| Time (sec) | | 25 | 15 | 12 | 8 | 5 |
| 1 | Amount of landing error | 0.002 | 0.002 | 0.002 | 0.002 | 0.002 |
| 30 | | 0.034 | 0.031 | 0.029 | 0.026 | 0.025 |
| 50 | | 0.050 | 0.045 | 0.041 | 0.037 | 0.035 |
| 80 | | 0.067 | 0.058 | 0.053 | 0.046 | 0.044 |
| 100 | | 0.077 | 0.064 | 0.058 | 0.050 | 0.047 |
| 140 | | 0.085 | 0.069 | 0.062 | 0.051 | 0.048 |
| 180 | | 0.087 | 0.069 | 0.060 | 0.047 | 0.044 |
| 220 | | 0.084 | 0.065 | 0.055 | 0.040 | 0.037 |
| 300 | | 0.070 | 0.051 | 0.040 | 0.032 | 0.021 |
| 600 | | 0.043 | 0.029 | 0.017 | 0.008 | −0.001 |

As shown in Table 2 and FIG. 9, as the height H of the skirt portion decreases, the height Ho of the part of the skirt portion which is opposite to the frame decreases accordingly. Consequently, heat transfer from the shadow mask to the frame decreases, and, therefore, landing error of the electron beam decreases. According to the result of the experiment shown in Table 2 and FIG. 9, landing error of the electron beam was remarkably decreased when the height H of the skirt portion is the same or shorter than 12 mm. When the height H of the skirt portion is 12 mm or below, height Ho of the part of the skirt portion which is opposite to the frame becomes 10 mm or below. Consequently, when height Ho of the part of the skirt portion which is opposite to the frame is 10 mm or below, landing error of the electron beam is remarkably reduced.

Figure 10:
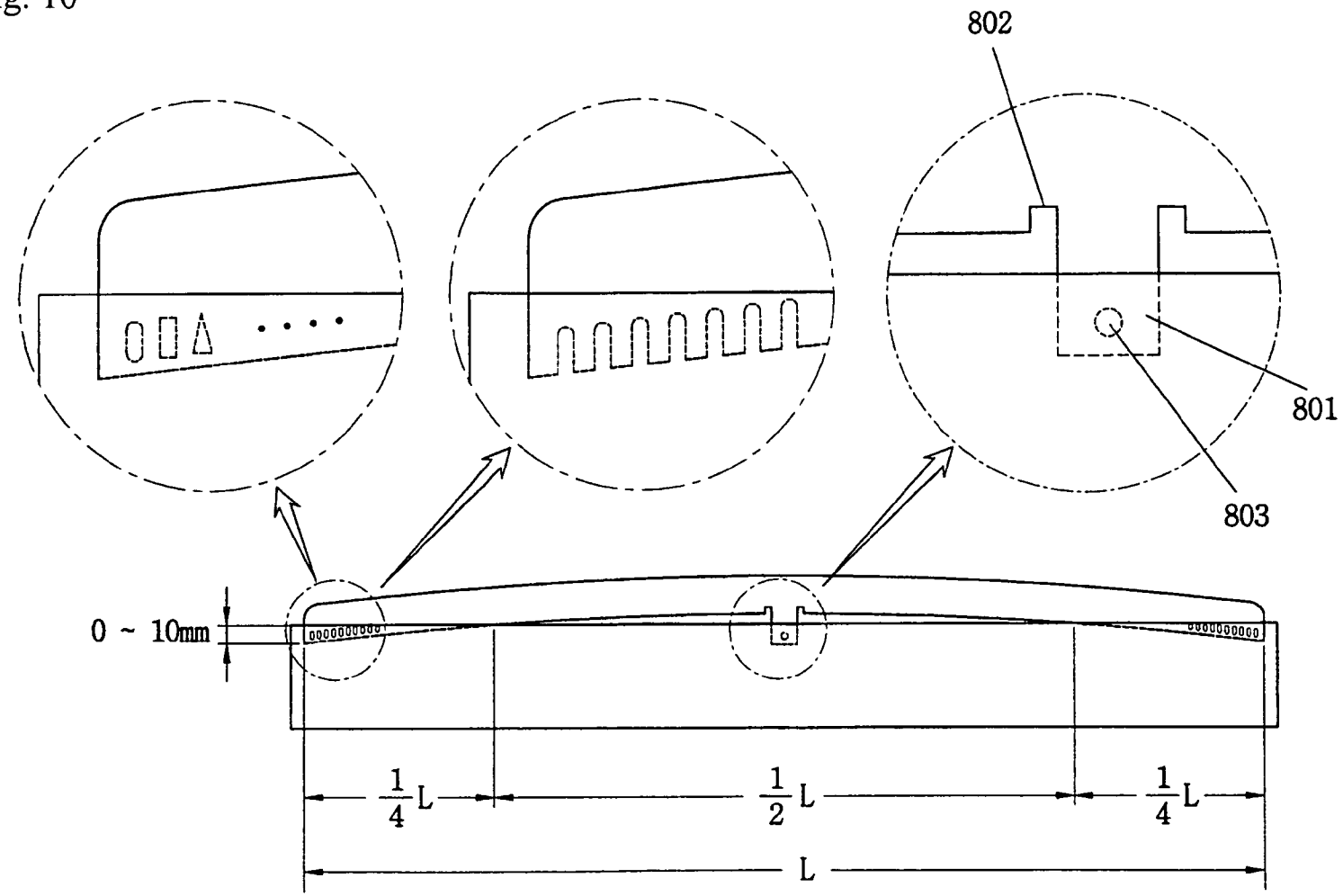
FIG. 10 shows a side view of the shadow mask according to a further modified version of Embodiment 1 of the present invention.

FIG. 10 shows a side view of the shadow mask according to a further modifed version of Embodiment 1 of the present invention. According to the further modifed version of Emodiment 1 of the prensent invention, the skirt portion has a extension 801 which has a welding point 803 to be joined to the frame by, e.g. welding. This extension may be provided instead of or in addition to welding points at 4 corners of the shadow mask. With the extension 801, it is possible to further reduce height Ho of the part in the skirt portion which is opposite to the frame. Moreover, it is possible to prevent the welding points at four corners of the shadow mask from becoming a binding when the mask expands. Therefore, landing error problem is reduced further.

<Embodiment 2>

According to another aspect of the present invention, A cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from said faceplate portion, said faceplate portion further comprising an apertured portion and a non-apertured portion surrounding said apertured portion; and a frame having a supporting portion joined to said skirt portion and a bottom portion bent inward from said supporting portion and extending by width Db from the long side of said supporting portion, wherein Db satisfies: Db<Hb×Lb/P+Nb where Lb represents distance between center point Fx of said faceplate portion and a long side of said apertured portion; Nb represents distance between the long side of said apertured portion and a long side of border of said faceplate portion from which said skirt portion is bent; P represents distance between the electron beams deflection center Dx and the center point Fx of said faceplate portion; Hb represents distance between the long side of the border of said faceplate portion and a long side of rear end line of said supporting portion from which said bottom portion is bent.

Embodiment 2 is related to optimization of long sides of the mask-frame assembly to reduce landing errors in a direction of short axis.

Figure 11:
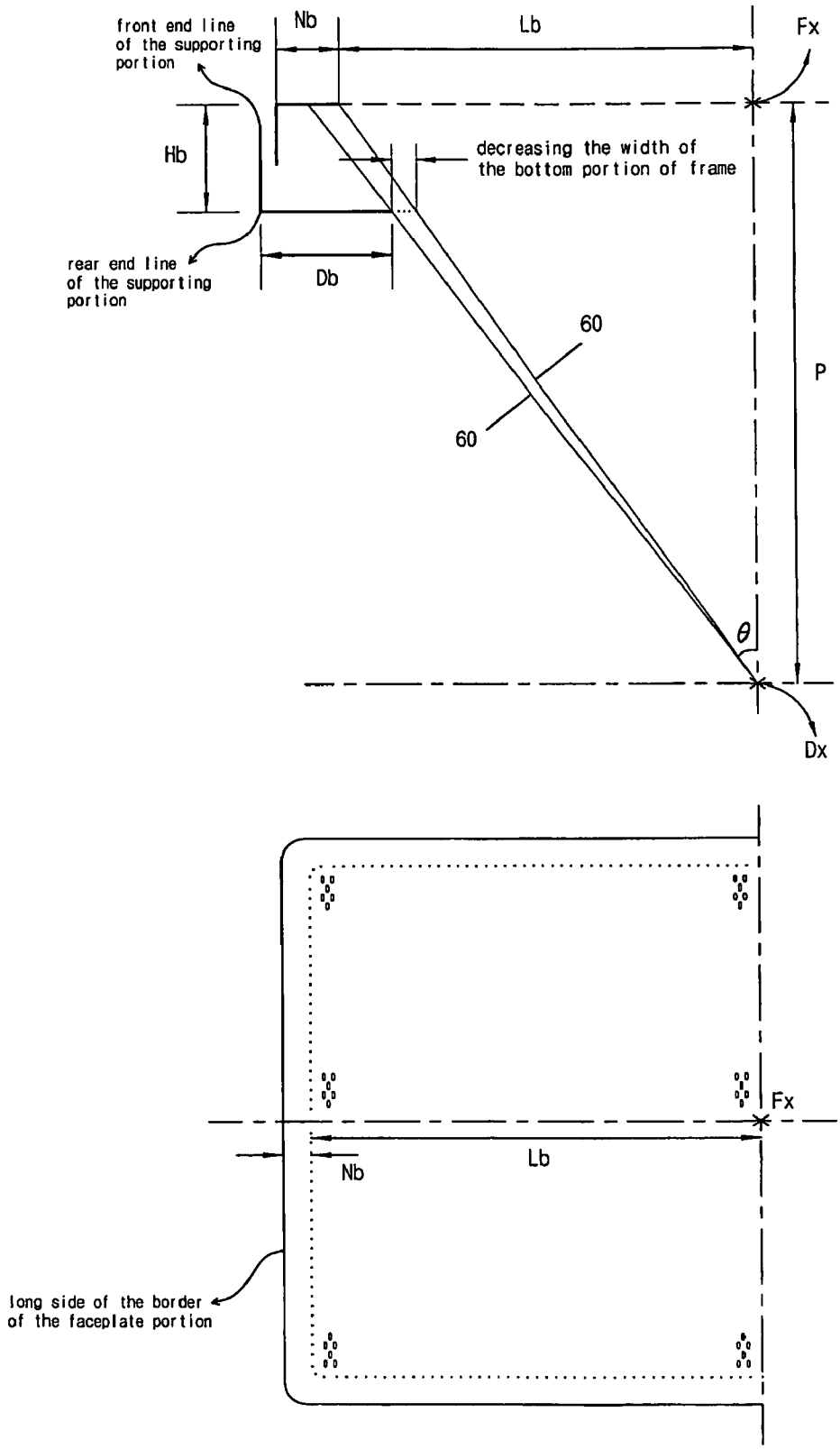
FIG. 11 shows a cross sectional view of the mask-frame assembly showing a major side of the mask-frame assembly.

FIG. 11 is a cross sectional view of the mask-frame assembly showing a short side of the mask-frame assembly. Hereinafter, following parameters are used in the description of the present invention. It is assumed that the faceplate portion of the mask is substantially flat.

Lb represents distance between center point Fx of faceplate portion and a long side of apertured portion.

Nb represents distance between a long side of apertured portion and a long side of border of faceplate portion from which skirt portion is bent.

P represents distance between electron beams deflection center Dx and the center point Fx of faceplate portion.

Hb represents distance between the long side of border of faceplate portion and a long side of rear end line of the supporting portion of the frame from which the bottom portion is bent.

Db represents width of the bottom portion by which the bottom portion extends inward from the rear end line of the long side of the supporting portion of the frame.

According to the present invention, the width of the bottom portion is decreased in comparison with the prior art such that the area on the shadow mask on which electron beam impinges is increased. It was found from the experiment that when the width of the bottom portion Db satisfies following Eqn. 3, the area on the shadow mask on which electron beam impinges is increased and, accordingly, temperature difference between central and border portion of the shadow mask is decreased. Therefore, amount of landing error is also decreased.

$$Db<Hb\times Lb/P+Nb \qquad \text{Eqn. 3}$$

When the width Db of the bottom portion 405 is substantially equal to Hb×Lb/P+Nb, electron beams impinge on as far as the border of the non-apertured portion of the shadow mask. In this manner, amount of electrons which reach the non-apertured portion increase as Da decreases. As the amount of electrons reaching the non-apertured portion increase, landing error is reduced and thereby doming proble is solved.

For Embodiment 2, the modifications made to Embodiment 1 as described above may also be applied. Such modifications includes: perporating holes at the skirt portion; limiting height of the portion in the skirt portion which is opposite to the frame; and providing extensions at the skirt portion. Detailed description of such modifications should be referred to that of Embodiment 1.

Embodiment 2 may further include such modifications as the use of AK material for the shadow mask; and coating an electron beams material on the surface of the shadow mask upon which electron beams are incident.

INDUSTRIAL APPLICABILITY

As described hereinabove, the present invention may accomplish the effect that landing error of electron beam, which is caused by non-uniform thermal expansion of the shadow mask, is reduced.

Further, according to the present invention, AK material may be used instead of invar material. Since AK material is not expensive in comparison with invar material, overall cost for making a shadow mask is reduced.

The invention claimed is:

1. A cathode ray tube comprising:

a panel on inner surface of which a phosphor screen is formed;

a funnel joined to the panel;

an electron gun generating electron beams;

a shadow mask mounted to the panel, the shadow mask having a faceplate portion and a peripheral skirt portion bent back from said faceplate portion, said faceplate portion further comprising an apertured portion and a non-apertured portion surrounding said apertured portion; and a frame having a supporting portion joined to said skirt portion and a bottom portion bent inward from said supporting portion and extending by width Da from the short side of said supporting portion, wherein Da satisfies:

$$Da<Ha\times La/P+Na$$

where La represents distance between center point Fx of said faceplate portion and a short side of said apertured portion;

Na represents distance between the short side of said apertured portion and a short side of border of said faceplate portion from which said skirt portion is bent;

P represents distance between the electron beams deflection center Dx and the center point Fx of said faceplate portion;

Ha represents distance between the short side of the border of said faceplate portion and a short side of rear end line of said supporting portion from which said bottom portion is bent.

2. The cathode ray tube of claim 1, wherein

Da satisfies:

$$Da<Ha\times(Na/5+La)/P+4Na/5.$$

3. The color cathode ray tube of claim 1, wherein said shadow mask is made of AK material.

4. The cathode ray tube of claim 3, wherein surface of said shadow mask upon which the electron beams are incident is coated by an electron beam reflecting material.

5. The cathode ray tube of claim 1, wherein surface of said shadow mask upon which the electron beams are incident is coated by an electron beam reflecting material.

6. The cathode ray tube of claim 1, wherein a plurality of holes are perforated at said skirt portion.

7. The cathode ray tube of claim 1, wherein a portion of said skirt portion is opposite to said frame, and height of the portion opposite to said frame is 10 mm or below.

8. The cathode ray tube of claim 1, wherein said skirt portion comprises an extension having a welding point to be welded to said frame.

9. A cathode ray tube comprising:

a panel on inner surface of which a phosphor screen is formed;

a funnel joined to the panel;

an electron gun generating electron beams;

a shadow mask mounted to the panel, the shadow mask having a faceplate portion and a peripheral skirt portion bent back from said faceplate portion, said faceplate portion further comprising an apertured portion and a non-apertured portion surrounding said apertured portion; and a frame having a supporting portion joined to said skirt portion and a bottom portion bent inward from said supporting portion and extending by width Db from the long side of said supporting portion, wherein Db satisfies:

$$Db<Hb\times Lb/P+Nb$$

where Lb represents distance between center point Fx of said faceplate portion and a long side of said apertured portion;

Nb represents distance between the long side of said apertured portion and a long side of border of said faceplate portion from which said skirt portion is bent;

P represents distance between the electron beams deflection center Dx and the center point Fx of said faceplate portion;

Hb represents distance between the long side of the border of said faceplate portion and a long side of rear end line of said supporting portion from which said bottom portion is bent.

10. The cathode ray tube of claim 9, wherein said shadow mask is made of AK material.

11. The cathode ray tube of claim 10, wherein surface of said shadow mask upon which the electron beams are incident is coated by an electron beam reflecting material.

12. The cathode ray tube of claim 9, wherein surface of said shadow mask upon which the electron beams are incident is coated by an electron beam reflecting material.

13. The cathode ray tube of claim 9, wherein a plurality of holes are perforated at said skirt portion.

14. The cathode ray tube of claim 9, wherein a portion of said skirt portion is opposite to said frame, and height of the portion opposite to said frame is 10 mm or below.

15. The cathode ray tube of claim 9, wherein said skirt portion comprises an extension having a welding point to be welded to said frame.

* * * * *